United States Patent [19]

Harnish

[11] 4,220,013

[45] Sep. 2, 1980

[54] PRESSURE COMPENSATED CONTROL FOR AIR CONDITIONING SYSTEM OR HEAT PUMP

[75] Inventor: James R. Harnish, York, Pa.

[73] Assignee: Borg-Warner Corporation, Chicago, Ill.

[21] Appl. No.: 912,637

[22] Filed: Jun. 5, 1978

[51] Int. Cl.[3] ..... F25B 41/00; F25B 1/00; F04B 49/00

[52] U.S. Cl. ..... 62/209; 62/226; 62/228; 417/19

[58] Field of Search ..... 62/209, 208, 226, 228; 417/19

[56] References Cited

U.S. PATENT DOCUMENTS

| | | | |
|---|---|---|---|
| 2,102,762 | 12/1937 | Summers | 62/228 D X |
| 2,209,979 | 8/1940 | Johnson | 62/226 X |
| 2,218,944 | 10/1940 | Wolfert | 62/4 |
| 2,367,306 | 1/1945 | Newton | 62/226 X |
| 2,720,084 | 10/1955 | Hailey | 62/209 X |
| 3,110,160 | 11/1963 | Miner | 62/209 X |
| 3,113,439 | 12/1963 | Eargle | 62/160 |
| 3,252,295 | 5/1966 | Leister, Jr. | 62/209 |
| 3,425,628 | 4/1969 | Russell | 62/228 |
| 3,563,048 | 2/1971 | Barry | 62/227 X |

FOREIGN PATENT DOCUMENTS

| | | | |
|---|---|---|---|
| 539151 | 8/1941 | United Kingdom | 62/208 |

*Primary Examiner*—William E. Wayner
*Assistant Examiner*—Harry B. Tanner
*Attorney, Agent, or Firm*—Thomas B. Hunter

[57] ABSTRACT

A pressure compensated safety control is employed to shut off the compressor at high compression ratios, caused, for example, by reduced air flow over the condenser or other reasons. This is especially useful on both reverse cycle heat pumps and conventional, non-reversible refrigeration and air conditioning systems to protect the compressor. In a preferred embodiment, the compensation is provided by making the control responsive to compressor suction pressure.

2 Claims, 2 Drawing Figures

Fig. 1.
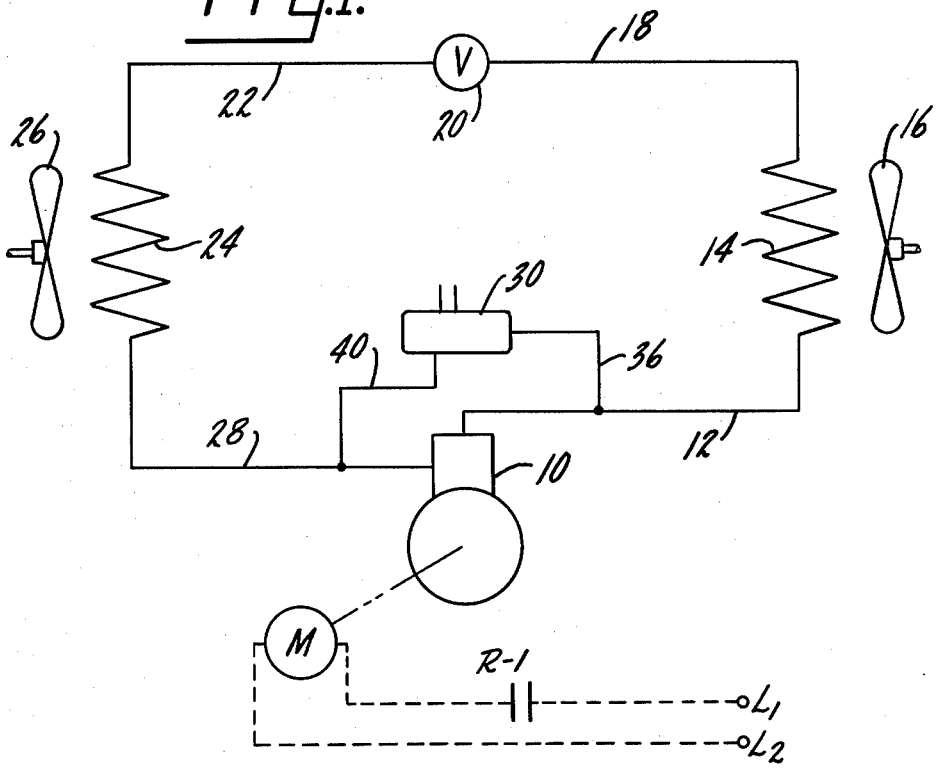
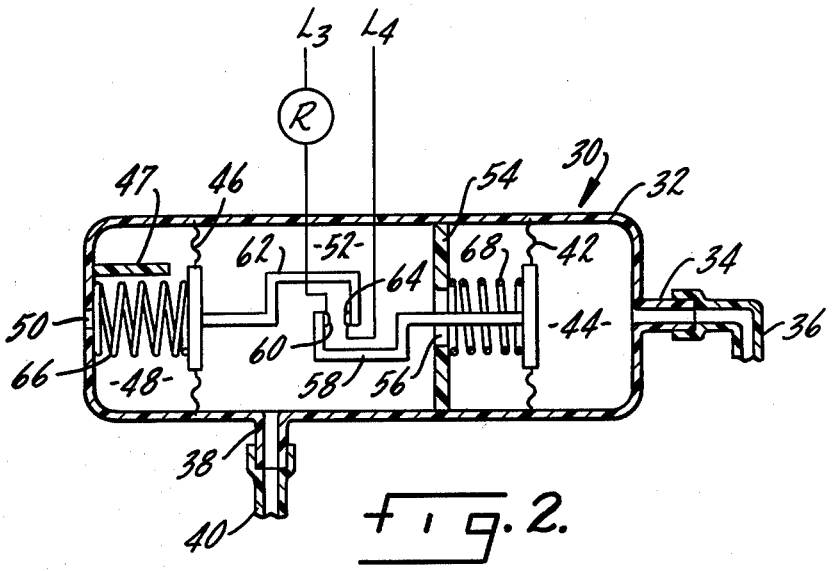
Fig. 2.

PRESSURE COMPENSATED CONTROL FOR AIR CONDITIONING SYSTEM OR HEAT PUMP

BACKGROUND OF THE INVENTION

1. Field of the Invention

Compensated controls for heat pumps and air conditioning units generally classified in Class 62, subclass 215.

2. Description of the Prior Art

U.S. Pat. No. 3,113,439 (Eargle) describes a heat pump system having an outdoor temperature compensated thermostat. A thermistor sensing outdoor ambient air temperature is provided in a circuit which will compensate the control in anticipation of heating and cooling requirements. The variable resistance of the thermistor controls the heat output of a small heater affecting the set point of the thermostat.

U.S. Pat. No. 3,252,295 (Leister Jr.) shows an air conditioning system in which both a low temperature start switch and a low pressure cutout switch cooperate with the power supply to the compressor. If suction pressure is too low, then the low pressure cutout switches off power unless the low temperature start switch is making contact. In this case, an alternate path of power to the compressor is provided.

U.S. Pat. No. 2,218,944 (Wolfert) describes a refrigeration system including a very complex control mechanism utilizing a low pressure bellows connected to the suction side of the system and a high pressure bellows connected to the discharge side of the compressor. These two devices cooperate to prevent start-up of the compressor in the event the pressure differential is above some predetermined maximum.

U.S. Pat. No. 3,425,628 (Russell) also describes a system using pressure control lines from the low pressure side of a system to maintain the pressure differential within a predetermined setting. Although similar to Wolfert, described above, this patent is slightly more simplified, but still requires an extraordinary number of levers and actuators to accomplish its function.

SUMMARY OF THE INVENTION

One of the most frequent problems encountered in the operation of heat pump systems (and, to a lesser extent, conventional, non-reversible air conditioning systems) is a dirty filter condition which restricts the flow of air circulated over the indoor coil. During heating operations of a heat pump, when the indoor coil is functioning as the condenser, a restricted air flow will greatly increase the condensing temperature and pressure. This condition may cause the compressor to fail due to high compression ratios, the most common failures being broken wrist pins, connecting rods and bearings.

In virtually all heat pump systems, there is a built-in, high pressure cutout. On Refrigerant-22 systems, this is usually set to interrupt power to the compressor at about 400 psia discharge pressure. At an evaporator temperature of 0° F., a compression ratio of 10.3 would be required before the conventional high pressure cutout would trip. This is well above the 8.5 compression ratio which is considered safe. At more extreme conditions, for example at −20° F. evaporator temperature, the compressor ratio would be as high as 16.1 before the high pressure shuts down the compressor.

Even with the normally safe high pressures obtained with satisfactory air flow across the indoor coil, the suction pressure can become abnormally low, due, for example, to a badly frosted outdoor coil, a failure of the outdoor fan and/or fan motor or loss of refrigerant in the system. When this occurs, the compression ratio can again become excessive and bring about premature failure of the compressor.

In the present invention, I have provided a compensated high pressure cutout which will stop the compressor at relatively low discharge pressures with a coincident low suction pressure condition. In other words, for normal operation, the set point of the high pressure cutout must be made sufficiently high to allow for operation when the suction pressure is relatively high in order to avoid the nuisance of power interruption to the compressor when it is not reasonably possible that the compressor would be harmed by the condition.

The present invention purposes a very simple device in which a pair of diaphragms cooperate with a switch, typically operating a relay contact for the compressor. One such diaphragm is subjected to high pressure from the discharge gas line between the compressor and the condenser and low pressure from the suction line between the evaporator and the compressor. The other diaphragm is subjected to low pressure at one side (from the suction side of the system) and ambient air pressure on the opposite side. These diaphragms cooperate in such a way that the control will shut off the compressor when a low suction pressure exists, even though the condenser pressure is within reasonable limits.

DESCRIPTION OF THE DRAWINGS

FIG. 1 is a schematic diagram of a vapor compression cycle refrigeration system.

FIG. 2 is a cross-section view, partly schematic in nature, illustrating the pressure compensated control apparatus in more detail.

DESCRIPTION OF THE PREFERRED EMBODIMENT

Referring now to the drawings, FIG. 1 shows, in schematic form a basic refrigeration system which for purposes of this description may be considered as a heat pump system (operating in the heating mode), or a conventional non-reversible refrigeration or air conditioning system. If considered as representing a heat pump system, it should be noted that the reversing valve and various check valves, expansion devices and accumulators, which are used in such systems, are not shown for simplicity.

As best shown in FIG. 1, a compressor 10 is connected by means of hot gas line 12 to condenser 14, which in heat pump systems (in the heating mode) is the indoor coil. A fan 16 circulates indoor air over the coil and the warm air is circulated throughout the heated space. Condensed refrigerant is transferred from condenser 14 through line 18 to an expansion device 20 which may be a capillary or a thermostatic expansion valve. The low pressure liquid refrigerant flows through line 22 to the evaporator 24 which in heat pump systems (operating in the heating mode) is the outdoor coil. A fan 26 circulates ambient air over coil 24 and the air gives up heat to the refrigerant causing it to vaporize. The low pressure vapor flows through line 28 to the suction side of the compressor.

The compressor 10 is driven by motor M which is supplied with electrical power through lines $L_1$, $L_2$ one of said lines containing a relay contact R-1. When R-1 is closed, the power is supplied to the motor to drive the compressor 10.

The pressure compensated cutout 30, the details of which are shown in FIG. 2, comprises a casing 32 which is connected at 34 to a high pressure line 36 leading to hot gas line 12. Casing 32 also has another connection 38 which connects to the suction side of the system through line 40. Inside the casing is a first diaphragm 42 which forms a closed chamber 44 subject to the pressure variations in the high pressure line 36. A second diaphragm 46 is disposed at the opposite end of the casing 32 and this forms a chamber 48 which is subjected on its left hand side to the pressure of ambient air as applied through a small port 50 at the left hand end. Diaphragms 46 and 42 are both subjected to low pressure which exists in the chamber 52 between the two diaphragms. Chamber 52 is partly divided by a partition 54; but, by virtue of the opening 56 in partition 54 the pressure is equalized on opposite sides of said partition.

The control device 30 includes a first contact arm 58 which is secured to diaphragm 42 and has an electrical contact 60 at the distal end thereof. A second contact arm 62 is attached to diaphragm 46 and has an electrical contact 64 at the distal end thereof. Contacts 60 and 64, respectively, are in series with a relay R adapted to be connected with a source of low voltage power through conductors $L_3$ and $L_4$.

Within chamber 48 is a spring 66 or other resilient means which biases the diaphragm 46 so that the contacts will tend to open. Another spring 68 cooperates with diaphragm 42, said spring being under compression and biasing the diaphragm in a direction tending to close contacts 60 and 64 to complete the circuit to relay R.

OPERATION

Assume that the compression pre-loads on springs 66 or 68 are set in such a way that contacts 60 and 64 will be closed when the suction pressure, as applied through line 40, is about 90 psia and the pressure in chamber 44, which is subject to discharge pressure is about 400 psia. This would give a pressure ratio of 44 which is satisfactory for safe operation of the compressor. If for some reason the suction pressure should drop to 30 psia, the reduced pressure acting at the left hand side of diaphragm 42, and the right hand side of diaphragm 46, would tend to open the contacts 60 and 64 and discontinue operation when the discharge pressure is 246 psia or higher. If the suction pressure maintained itself at 90 psia and discharge pressure was raised to 400 psia, then pressure acting on the right hand face of diaphragm 42 would move contact arm 58 to the left and open the contacts. A stop 47 can be located on the left side of diaphragm 46 to prevent further biasing of the left side when suction pressure rises above about 90 psia.

While this invention has been described in connection with a certain specific embodiment thereof, it is to be understood that this is by way of illustration and not by way of limitation; and the scope of the appended claims should be construed as broadly as the prior art will permit.

What is claimed is:

1. A vapor compression cycle refrigeration system comprising: a compressor having a discharge outlet and a suction inlet; a condenser; an expansion device; and an evaporator, all connected in closed circuit relation such that the high pressure side of the system is between the compressor discharge outlet and the expansion device and the low pressure side of the system is between said expansion device and said compression suction inlet; an electric motor driving said compressor; and cutout means for discontinuing the power supplied to said electric motor including first pressure responsive means responsive to pressure both on the high pressure and low pressure sides of said system and second pressure responsive means responsive to pressure on the low pressure side of said system and a relatively fixed reference pressure, said cutout means further including first resilient means for biasing said first pressure responsive means and second resilient means for biasing said second pressure responsive means, and switch means operated in response to said first and second pressure responsive means and said first and second resilient means such that a decrease in low side pressure will tend to open said switch means and a decrease in high side pressure will tend to close said switch means, said first pressure responsive means includes a flexible diaphragm, the movement of which is a function of the pressures existing on both the high pressure side and the low pressure side of said system; and said second pressure responsive means includes a second flexible diaphragm, the movement of which is dependent solely on the low pressure side of said system balanced against atmospheric pressure; and first and second electrical contacts operatively connected to said first and second diaphragms respectively.

2. A pressure compensated high pressure cutout switch adapted to control the operation of a refrigeration system compressor including a housing; a flexible diaphragm forming a chamber at one end of said housing, which chamber is connected with the high pressure side of said refrigeration system; a second flexible diaphragm cooperating with said housing to form a second chamber at the opposite end of said housing; said chamber being subjected to a relatively fixed reference; means defining a third chamber between said first and second flexible diaphragms, said chamber being subject to pressure on the low side of said refrigeration system, and switch means operatively connected to said first and second diaphragms and adapted to make and break contact.

* * * * *